US005600981A

United States Patent [19]

Sievert

[11] Patent Number: 5,600,981

[45] Date of Patent: Feb. 11, 1997

[54] SNAP-IN TUMBLER

[75] Inventor: Timothy A. Sievert, Milwaukee, Wis.

[73] Assignee: Strattec Security Corporation, Milwaukee, Wis.

[21] Appl. No.: 383,225

[22] Filed: Feb. 3, 1995

[51] Int. Cl.[6] ..... E05B 27/00; E05B 15/14

[52] U.S. Cl. ..... 70/492; 70/377

[58] Field of Search ..... 70/369, 375, 377, 70/384, 492

[56] References Cited

U.S. PATENT DOCUMENTS

| | | | |
|---|---|---|---|
| 1,664,404 | 4/1928 | Douglas | 70/377 X |
| 1,726,614 | 9/1929 | Falk | 70/492 |
| 1,874,877 | 8/1932 | Brauning | 70/367 |
| 2,123,940 | 7/1938 | Gray | 70/377 X |
| 2,890,582 | 6/1959 | Navarro | 70/377 X |
| 3,137,156 | 6/1964 | Navarro | 70/492 |
| 3,854,311 | 12/1974 | Mercurio | 70/492 |
| 4,052,870 | 10/1977 | Degeye et al. | 70/492 |
| 4,057,987 | 11/1977 | Patriquin | 70/364 |
| 4,398,405 | 8/1983 | Patriquin | 70/369 |
| 4,416,129 | 11/1983 | Thimot | 70/369 |
| 4,715,201 | 12/1987 | Craig | 70/369 |
| 4,972,695 | 11/1990 | Mochida et al. | 70/492 |
| 4,976,123 | 12/1990 | Ceron et al. | 70/371 X |
| 5,088,305 | 2/1992 | Myers | 70/369 |
| 5,265,455 | 11/1993 | Grimmer | 70/377 X |

FOREIGN PATENT DOCUMENTS

| | | | |
|---|---|---|---|
| 2276447 | 2/1976 | France | 70/377 |
| 2393906 | 2/1979 | France | 70/492 |

*Primary Examiner*—Suzanne L. Dino
*Attorney, Agent, or Firm*—Andrus, Sceales, Starke & Sawall

[57] ABSTRACT

A cylinder assembly for a plate tumbler lock includes a plate tumbler which snap-fits into an assembled position by pushing the tumbler into its ward until a projecting detent flexes inwardly and passes by a retaining ledge in the side wall of the ward, and thereafter springs back outwardly so that the detent is retained by the ledge. A pair of notches, one located above and one below the tumbler detent, permit the tumbler to flex inwardly as the tumbler detent passes over the retaining ledge to eliminate any significant forces acting between the detent, the side wall of the tumbler ward and the retaining ledge, and thereby minimize the metal deformation of these components.

1 Claim, 2 Drawing Sheets

SNAP-IN TUMBLER

BACKGROUND OF THE INVENTION

The present invention relates to locks, and more particularly to an improved cylinder assembly for a plate tumbler lock which includes a snap-in plate tumbler construction.

Conventional plate tumbler locks include a key operated cylinder rotatably mounted in a cylindrical sleeve. The cylinder includes a plurality of plate tumblers which are biased by springs to normally project into the sleeve to prevent rotation of the cylinder. When a properly bitted key is inserted into the key way of the cylinder, and thus through slots formed in each tumbler, the tumblers are retracted from the sleeve into their respective wards to unlock the cylinder and allow the cylinder to rotate within the sleeve.

In the manufacture, shipping and assembling of plate tumbler locks, the tumblers must be retained within the cylinder in order to prevent them from accidently falling out of the cylinder. The plate tumblers are spring loaded and, since each tumbler ward has an open top which opens to the external surface of the cylinder, there is nothing to prevent the springs from urging the plate tumblers from their wards when the cylinder is not contained within a lock housing such as a hollow cylinder sleeve. These cylinders typically are shipped separately from the remaining lock components, such as the sleeve, with the plate tumblers in place and thus the plate tumblers need to be held within the cylinder by some means. If, for example, an assembler accidentally permits one of these plate tumblers to pop out of the cylinder, there is a waste of time during assembly. If, however, two or more plate tumblers should accidentally fall out, the combination might be lost if these plate tumblers are not reinserted into the cylinder in the correct order.

In the past, plate tumblers have been held in place by means of a retaining plate placed over the open top of the tumbler access wards in the cylinder. This retaining plate is typically staked into the cylinder. Other methods of retaining the plate tumblers include tumblers that "snap into" the cylinder by forming a shoulder on the plate tumbler for engagement with a corresponding detent or other means on the cylinder housing. Examples of such retaining methods are shown in the following U.S. Pat. Nos. 1,726,614; 1,860,708; 2,123,940; 2,890,582; 3,137,176; 4,416,129; 4,672,827.

Prior snap-in tumblers are force fit into their respective tumbler wards during assembly. This force fitting of the tumbler during assembly typically causes burrs or metal deformation of either the projecting detent on the tumbler or the retaining ledge in the ward or both resulting in the accuracy of the tumbler being compromised since the tumbler may not properly locate itself against the retaining ledge formed in the ward. Thus, a key may not properly cooperate with such a tumbler resulting in a defective lock.

One self-retained, snap-in tumbler is illustrated and described in U.S. Pat. No. 5,088,305. However, the tumbler described therein, although removable, may still result in deformation of the detent projecting from the tumbler or the retaining ledge on the tumbler ward since the detent must be forced to pass over the retaining ledge.

It would thus be desirable to provide a cylinder assembly having a snap-in plate tumbler which does not require excessive force fitting of the tumbler during assembly.

SUMMARY OF THE INVENTION

A cylinder assembly for a plate tumbler lock is disclosed which includes a snap-in plate tumbler which is self-retaining during assembly and also is easily assembled without excessive deformation of the tumbler detent or the ward's retaining ledge. The tumbler is retained within the cylinder for the lock by means of a projecting detent formed along one edge thereof which engages a retaining ledge formed along one side wall of a tumbler ward. A pair of notches, one located above and one below the tumbler detent, in the one edge of the tumbler permit the tumbler to flex inwardly so that as the tumbler is pressed into its ward, and the tumbler detent passes over the retaining ledge, the tumbler flexes inwardly to eliminate any significant forces acting between its projecting detent, the side wall of the tumbler ward and the retaining ledge. Thus, when the tumbler is inserted into its ward, the projecting detent passes freely by the retaining ledge so that no metal deformation occurs. Once passed the ledge, the tumbler detent springs back outwardly into its assembled position due to the resiliency of the tumbler material and thus snap-fits into the ward and is self-retained therein.

The resiliency of the tumbler may be provided by insuring that the distance between the central slot formed in the tumbler and the innermost point or root of the notches in the tumbler is approximately equal to or greater than the thickness of the tumbler. This minimizes the distance between these two points to permit flexing of the tumbler yet retain sufficient material to retain the integrity of the tumbler.

The present invention thus provides a simple and inexpensive means whereby plate tumblers are prevented from falling out of the cylinder when the cylinder is disassembled from the complete lock. The present cylinder assembly is particularly advantageous when the cylinder is shipped and when the cylinder is being assembled into the cylinder sleeve of the lock since it prevents the accidental removal of the tumblers by preventing the tumblers from falling out of the cylinder during assembly or shipping without causing any physical damage to the structure of either of the tumbler itself or the tumbler ward.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
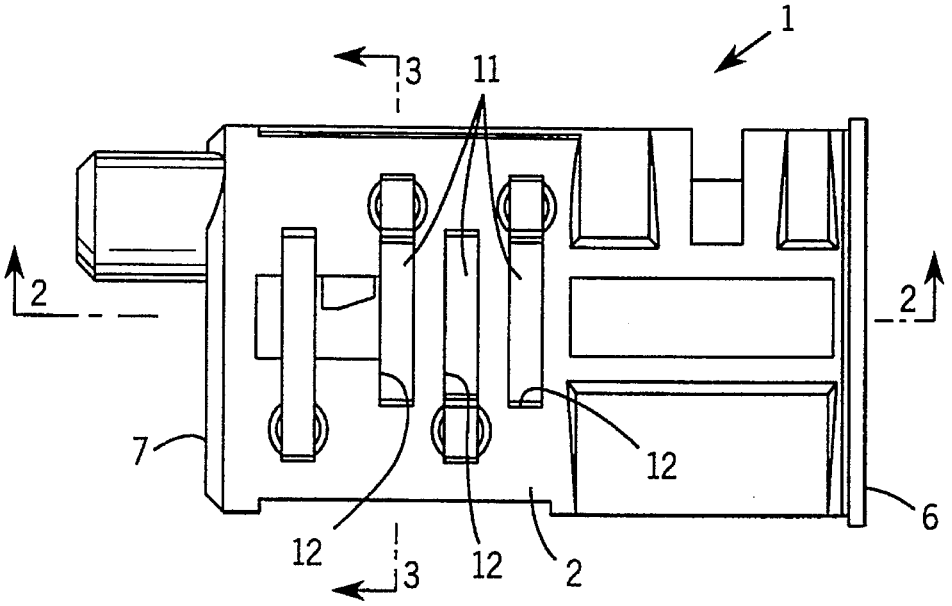
FIG. 1 is a side view of a lock cylinder including the self-retained, snap-in plate tumblers in accordance with the present invention.

Referring now to the drawings, FIG. 1 illustrates a lock cylinder generally designated by the numeral 1 constructed in accordance with the principals of the present invention. Cylinder 1 is of the type that may be rotatably mounted within a hollow cylindrical housing or sleeve member (not shown) which in turn is mounted in the glove compartment of an automobile. Other uses, however, are contemplated for cylinder 1 and therefore the present invention is not limited to the use as a glove compartment lock for an automobile.

Figure 2:
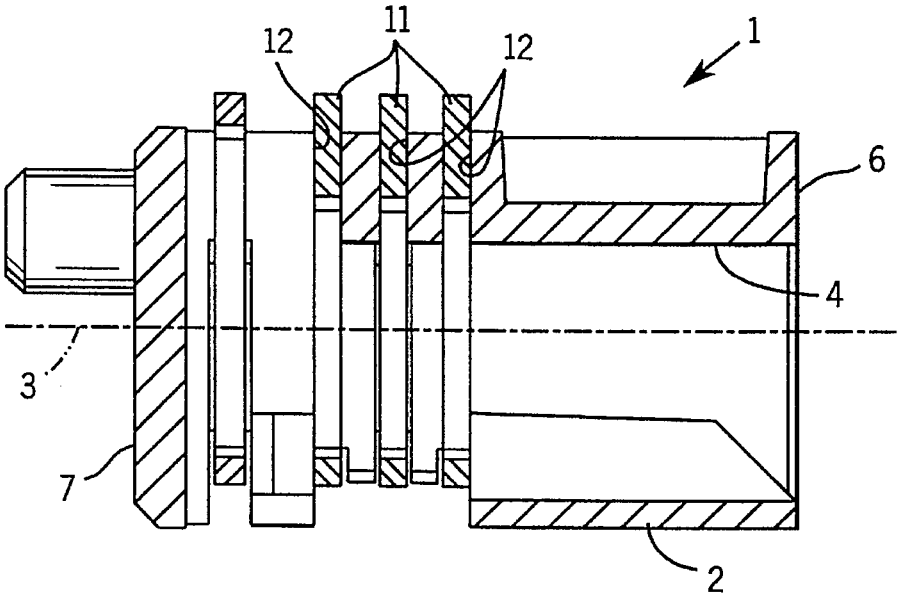
FIG. 2 is a cross-sectional view of the cylinder taken along the plane of the line 2—2 in FIG. 1.

As shown best in FIGS. 1 and 2, cylinder 1 is in the form of a cylindrical, substantially hollow housing 2 which defines a central longitudinal axis 3 about which cylinder 1 is rotated. Housing 2 includes a central key way 4 disposed along axis 3 for receiving a key in the conventional manner to permit rotation of cylinder 1. Key way 4 opens to its front end at front face 6 of housing 2 and is blind or closed at opposite end 7 of housing 2.

A plurality of plate tumblers 11 are slidably mounted within a corresponding number of tumbler slots or wards 12 contained within housing 2 each of which are orientated transversely in a plane passing perpendicularly through axis 3. Each ward 12 has an open bottom 13 and an open top 14 both of which open to the external cylindrical surface 15 of cylinder 1. Only one plate tumbler 11 in a single ward 12 is illustrated in full in FIGS. 3–4 with the remaining tumblers and wards not illustrated for purposes of simplicity. However, as is conventional, each tumbler 11 is slidably mounted within a corresponding ward 12 that opens to the outer surface 15 of housing 2.

Figure 3:
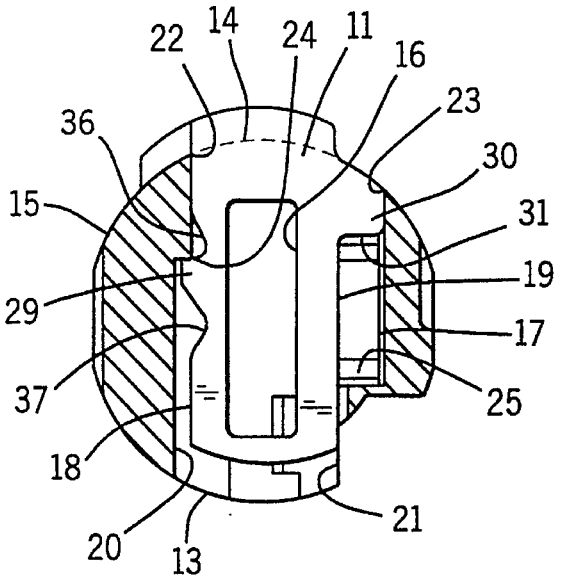
FIG. 3 is a cross-sectional view taken along the plane of the line 3—3 in FIG. 1 illustrating the tumbler in its assembled position.
Figure 4:
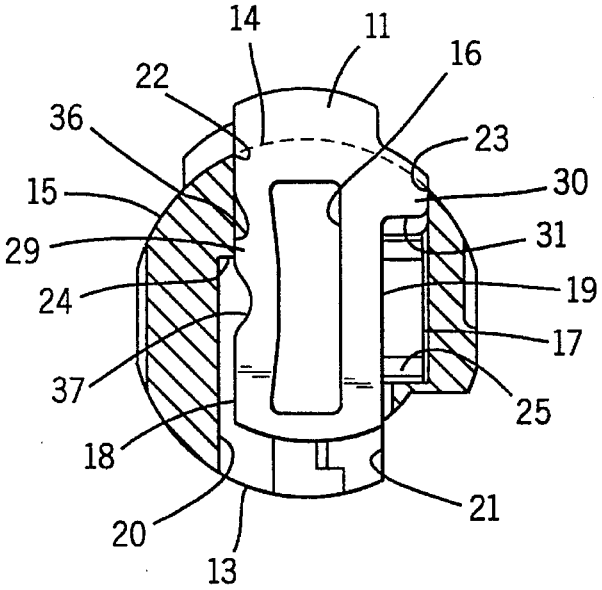
FIG. 4 is a cross-sectional view similar to FIG. 3 illustrating the tumbler in its flexed position.

As shown best in FIGS. 3–4, each ward or slot 12 is defined by opposite side walls 20 and 21 in housing 2 which guide tumbler 11 in its sliding movement. Side walls 20 and 21 terminate at terminal edges 22 and 23 respectively, which define the open top 14 for receiving tumblers 11 during assembly. A retaining ledge 24 is formed in side wall 20 of ward 12 for engaging and retaining tumbler 11, as will hereinafter be described. As shown, retaining ledge 24 is in the form of a shoulder approaching about 90°, but other forms of retaining means may also be employed. The opposite side wall 21 of ward 12 includes a flat lower tumbler spring seat 25 formed therein. Like ledge 24, seat 25 is in the form of a 90° shoulder or recess formed in housing 2. Like ledge 24, seat 25 may also be constructed in other conventional constructions so long as a seat is formed for the tumbler biasing spring 17, as will hereinafter be described.

As shown best in FIGS. 3–4, each plate tumbler 11 is substantially rectangular in shape having a central key receiving opening 16 and a pair of opposite side edges 18 and 19. Side edge 18 slidably engages wall 20 of ward 12 while opposite side edge 19 slidably engages side wall 21 of ward 12 for guiding tumbler 11 in its sliding movement within ward 12. Each tumbler 11 includes a detent 29 projecting from side edge 18 and a leg 30 projecting from opposite side edge 19. Leg 30 includes a lower flat surface 31 forming an upper tumbler spring seat which is located opposite from lower seat 25 of housing 2 when tumbler 11 is in its operational position. A tumbler spring 17 extends between and bears against seat 31 at its upper end and seat 25 at its lower end. Tumbler spring 17 thus biases tumbler 11 toward the open top 14 of ward 12 so that tumblers 11 are always biased into their locking position and the insertion of a key retracts tumblers 11 into wards 12 to unlock cylinder 1.

During manufacturing, shipping and/or assembling of cylinder 1, plate tumblers 11 must be retained within the individual slots or wards 12 so that they cannot "pop out" or fall out of housing 2 when a key is removed. In order to accomplish this, a retaining means is provided which enables each plate tumbler 11 to be "self-retaining" in that no extra parts are necessary for retaining tumblers 11 within housing 2 in addition to those already described herein. In order to accomplish this, each plate tumbler 11 includes detent 29 formed along side edge 18 which functions to catch or engage retaining ledge 24 formed on side wall 20 of ward 12. As another feature of the present invention, the retaining of tumblers 11 in wards 12 is accomplished without any physical damage, i.e. metal deformation to the structure of tumbler 11, detent 29 or retaining ledge 24. This latter feature is accomplished by providing a pair of notches 36 and 37 along edge 18 of each tumbler 11, one notch located on each side of detent 29. Notch 36 is located above detent 29 while notch 37 is located below detent 29. The depth of notches 36 and 37 is such that the distance between the opening 16 and the deepest point or root of each notch 36 and 37 is approximately equal to or greater than the thickness of tumbler 11. This minimizes the distance between notches 36 and 37 and opening 16 to permit flexing of the tumbler 11 as the detent 29 passes over the retaining ledge 24 (see FIG. 4) during insertion into ward 12 to thereby reduce to a minimum the forces interacting between detent 29 and retaining ledge 24. As a result, no metal deformation occurs with either detent 29 or retaining ledge 24 during the insertion and resultant snapping in of tumbler 11 into ward 12.

In operation, tumbler 11 is retained within cylinder 1 in the following manner. First, tumbler spring 17 is inserted into ward 12 within housing 2 through the open top 14 of ward 12 until spring 17 is engaged with lower seat 25. Plate tumbler 11 is then inserted into ward 12 through the open top 14 of ward 12 and pushed into cylinder 1 to compress spring 17. When detent 29 is received within ward 12, it begins to slidably engage side wall 20. Thereafter, tumbler 11 is pushed into ward 12 until detent 29 passes by retaining ledge 24 so that its upper surface clears the edge of retaining ledge 24. As this occurs, the tumbler 11 flexes inwardly. Once past ledge 24, detent 29 springs back outwardly, i.e. to the left in FIGS. 3–4 due to the resiliency of the tumbler material and thus snap fits into the ward 12 and is self-retained therein. Tumbler 11 thus moves from its initial non-assembled position to an assembled position wherein it snaps into ward 12 without interference or hinderance between tumbler 11 and wards 12 and without any metal deformation of detent 29 and retaining ledge 24. As shown best in FIG. 3, tumbler 11 has been moved from its non-assembled position, to its assembled position. In its assembled position, tumbler 11 is "self-retained" since the interference of detent 29 with retaining ledge 24 prevents tumbler 11 from being forced out of ward 12 by spring 17. This procedure is repeated until all of the tumblers are inserted into their respective wards 12.

A self-retained, snap-fitting tumbler for a plate tumbler lock has been illustrated and described. Various modifications and/or substitutions of the specific components described herein may be made without departing from the scope of the present invention. For example, the specific shape of detent 29 may be modified to cooperate with specific designs for the retaining ledge 24. The depth of notches 36 and 37 may also be modified depending upon the materials of construction for tumbler 11 and/or the amount of flexing desired. Also, different shapes of plate tumblers 11 may be employed other than that specifically described herein. In addition, the cylinder construction described and illustrated herein may be utilized with "double throw" locks, i.e. tumblers that are biased and project radially in opposite directions from a cylinder. These and other modifications can be made herein without departing from the scope of the present invention.

Various modes of carrying out the invention are contemplated as being within the scope of the following claims particularly pointing out and distinctly claiming the subject matter regarded as the invention.

I claim:

1. A cylinder assembly for a plate tumbler lock, comprising:

a cylindrical housing defining an external cylindrical surface, opposite ends, a longitudinal axis and a key way disposed along said axis opening to one end of said housing for slidably receiving a key therein, said housing further including a tumbler ward extending radially from said axis and having an open top which opens to said external cylindrical surface, said tumbler ward defined by a pair of opposite side walls, one of said side walls including a tumbler retaining ledge formed therein and the other of said side walls including a first tumbler spring seat formed therein, and each of said side walls including a terminal edge at said external cylindrical surface defining said open top;

a plate tumbler disposed in said ward for sliding movement radially with respect to said axis, said plate tumbler including a central key-receiving opening aligned with said key way defining a top, a bottom, a first narrow side and a second opposite side, the opposite sides interconnected with said top and bottom and each including an outer side edge and an inner side edge, said outer side edge of said first narrow side including a detent projecting therefrom and said outer side edge of said second side including a leg projecting therefrom defining a second tumbler spring seat;

tumbler spring means within said housing for biasing said plate tumbler outwardly in said ward toward said open top, said tumbler spring means having a lower end engaging the first seat formed in said outer side wall and an upper end engaging said second seat formed in said leg; and means for permitting resilient flexing of said detent inwardly toward said key-receiving opening, said means comprising:

said first narrow side of said plate tumbler dimensioned sufficiently narrow so that when said plate tumbler slidably moves in said ward between a non-assembled position and an assembled position said detent engages said retaining ledge and said first side of said plate tumbler flexes inwardly as said detent passes over said retaining ledge until said tumbler snap-fits into and is retained within said tumbler ward without any physical damage to said retaining ledge and said detent; and a pair of notches in said first narrow side of said tumbler, one notch located above said detent and the other notch located below said detent, each notch includes a root defining a depth such that the distance from the root of said notch to said inner side edge of said first narrow side of said tumbler is equal to or greater than the thickness of said tumbler.

* * * * *